US007898321B2

(12) United States Patent
Hayashi

(10) Patent No.: US 7,898,321 B2
(45) Date of Patent: Mar. 1, 2011

(54) DRIVER CIRCUIT

(75) Inventor: Tsuneyuki Hayashi, Tokyo (JP)

(73) Assignee: Texas Instruments Incorporated, Dallas, TX (US)

( * ) Notice: Subject to any disclaimer, the term of this patent is extended or adjusted under 35 U.S.C. 154(b) by 11 days.

(21) Appl. No.: 12/368,006

(22) Filed: Feb. 9, 2009

(65) Prior Publication Data

US 2009/0230998 A1 Sep. 17, 2009

(30) Foreign Application Priority Data

Feb. 7, 2008 (JP) ..... 2008-027120

(51) Int. Cl.
*G05F 3/02* (2006.01)

(52) U.S. Cl. ..... 327/543; 327/109

(58) Field of Classification Search ..... 327/109, 327/543

See application file for complete search history.

(56) References Cited

U.S. PATENT DOCUMENTS 5,235,218 A * 8/1993 Matsuo et al. ..... 327/538
5,612,614 A * 3/1997 Barrett et al. ..... 323/316
6,466,481 B1 * 10/2002 Pasotti et al. ..... 365/185.21
6,690,229 B2 * 2/2004 Rudolph ..... 327/543
6,998,831 B2 * 2/2006 Charlon ..... 323/316
7,463,082 B2 * 12/2008 Chen ..... 327/543
7,679,353 B2 * 3/2010 Noda ..... 323/315
7,728,654 B2 * 6/2010 Hsieh et al. ..... 327/543
2006/0202763 A1 * 9/2006 Niki et al. ..... 330/288

* cited by examiner

*Primary Examiner* — Lincoln Donovan

*Assistant Examiner* — Ryan C Jager

(74) *Attorney, Agent, or Firm* — John J. Patti; Wade J. Brady, III; Frederick J. Telecky, Jr.

(57) ABSTRACT

A driver is provided. The driver generally comprises a current source, a current mirror, an amplifier and a presetting circuit. The current source is generally adapted to provide a reference current to the current mirror. The transistor is coupled to the current mirror. The amplifier has the first input that is coupled to the current mirror, a second input that is coupled to a node between the transistor and the current mirror, and an output that is coupled to the control electrode of the transistor. The presetting circuit is coupled to the control electrode of the transistor so that it can preset the potential of the control electrode of the transistor to a potential that allows current driving of the transistor with a predetermined timing after a control signal is received.

17 Claims, 4 Drawing Sheets

DRIVER CIRCUIT

CROSS-REFERENCE TO RELATED APPLICATIONS

This application claims priority to Japanese Patent Application Ser. No. 2008-027120, entitled "Driver Circuit," filed on Feb. 7, 2008, which is hereby incorporated by reference for all purposes.

TECHNICAL FIELD

The invention relates generally to driver circuitry and, more particularly, to driver circuitry for light emitting elements.

BACKGROUND

In recent years, applications in which LEDs or light-emitting diodes are used have become popular. Accompanying this trend, a number of LED driver ICs or integrated circuits have been used in to control the LEDs. An example of a convention LED driver is shown in FIG. 1, and a timing diagram corresponding to the general operation of the convention LED drive of FIG. 1 is shown in FIG. 2. Now, turning to FIG. 1, the reference numeral 100 generally designates the conventional LED driver. LED driver 100 is generally comprised of current source 102, amplifier 102, and transistors N1 through N4 (NMOS FETs) and P1 (PMOS FET).

In operation, transistors N1 and N2 operate as a current mirror circuit so that when reference current Iref flows through transistor N2, the mirror current also flows through transistor N1, forming output current Io. If transistor1 N2 and N1 have the same general structure and the size ratio (generally, 1:n), output current Io will be determined by the following equation: 1o=n*Iref. In principle, a constant current can be obtained; however, in practice, the output current Io will vary with changes in the output voltage due to the Early effect, which is undesirable.

One way of reducing this variation in the output current due to the Early effect is to employ the configuration of transistors N1 and N5, which are cascade-connected. Here, transistor N5 operates to suppress variations in the output current despite variations in the output voltage. To accomplish this, amplifier 104 is used to control the transistor N5, where the non-inverting input terminal of amplifier 104 is connected to the gate electrode of transistor N2 that sets reference current Iref and where the inverting input terminal of amplifier 104 is connected to the source terminal of output transistor N5 on the upper side of the cascade connection. Additionally, the output of amplifier 104 is connected to the gate terminal of transistor N5. Amplifier 104 operates to generally ensure that the voltage at the non-inverting input terminal and voltage at the inverting input terminal (the drain voltage of transistor N5) are generally the same. As a result, the gate and drain voltages of transistors N2 and N1, which form a current mirror circuit are the same, so that the circuit operation is unaffected by changes in the output voltage. Thus, amplifier 104 operates as a negative feedback circuit, and the gate potential of output transistor N5 is controlled corresponding to variations in the output voltage, so that the output current can be kept constant.

Now turning to FIG. 2, a timing diagram of the operation of the driver 100 is shown. At time t1, control signal transitions to from logic high to logic low. At time t1, the voltage at node s1 remains at logic high, while the voltage at node s2 transitions to logic high and the voltage at node s3 transitions to logic low. This results in the voltage at node s4 having to increase between times t1 and t2. Thus, the output current is not constant during the period from time t1 to t2. Therefore, there is a need for a circuit that provides a generally constant output current.

SUMMARY

A preferred embodiment of the present invention, accordingly, provides an apparatus. The apparatus comprises a current source that is adapted to provide a reference current; a current mirror that is coupled to the current source; a transistor that is coupled to the current mirror; an amplifier having a first input, a second input, and an output, wherein the first input of the amplifier is coupled to the current mirror, and wherein the second input of the amplifier is coupled to a node between the transistor and the current mirror, and wherein the output of the amplifier is coupled to the control electrode of the transistor; and a presetting circuit that is coupled to the control electrode of the transistor, wherein the presetting circuit presets the potential of the control electrode of the transistor to a level that allows current driving of the transistor with a predetermined timing after a control signal is received.

In accordance with a preferred embodiment of the present invention, the presetting circuit further comprises a delay circuit that is adapted to receive the control signal; logic that is coupled to the delay circuit; a current generating circuit that is coupled to the logic; and a second transistor that is coupled between the current generating circuit and the control electrode of the first transistor and that is coupled the logic at its control electrode.

In accordance with a preferred embodiment of the present invention, the current generating circuit further comprises a third transistor that is coupled to the logic at its control electrode; a second current mirror that is coupled to the third transistor; a third current mirror that is coupled to the second current mirror; and a fourth transistor that is coupled to the third current mirror.

In accordance with a preferred embodiment of the present invention, the current generating circuit further comprises a third transistor that is coupled to the logic at its control electrode; a second current mirror that is coupled to the third transistor; a fourth transistor that is coupled to the second current mirror, wherein the fourth transistor is diode-connected; a fifth transistor that is coupled to the fourth transistor; a sixth transistor that is coupled to the second current mirror; a seventh transistor that is coupled to the second current mirror and the sixth transistor, wherein the seventh transistor is diode connected; a eighth transistor that is coupled to the second current mirror, the sixth transistor, and the seventh transistor; and a ninth transistor that is coupled to the eighth transistor and the first terminal of the amplifier.

In accordance with a preferred embodiment of the present invention, the logic further comprises a NAND gate that is coupled to the delay circuit; and an inverter that is coupled to the NAND gate.

In accordance with a preferred embodiment of the present invention, the delay further comprises a first inverter that is adapted to receive the control signal; and a second inverter that is coupled to the first inverter.

In accordance with a preferred embodiment of the present invention, the apparatus further comprises a control circuit that is coupled to the current mirror and the transistor, wherein the control circuit is adapted to receive the control signal.

In accordance with a preferred embodiment of the present invention, the control circuit further comprise a second transistor that is coupled between the current mirror and ground and that is adapted to receive the control signal at its control electrode; and a third transistor that is coupled between the output of the amplifier and the current mirror.

In accordance with a preferred embodiment of the present invention, an apparatus is provided. The apparatus comprises a current source that is adapted to provide a reference current; a current mirror that is coupled to the current source; a first transistor that is coupled to the current mirror; an amplifier having a first input, a second input, and an output, wherein the first input of the amplifier is coupled to the current mirror, and wherein the second input of the amplifier is coupled to a node between the first transistor and the current mirror, and wherein the output of the amplifier is coupled to the control electrode of the first transistor; an control circuit that is coupled to the current mirror and to the control electrode of the first transistor, wherein the control circuit is adapted to receive a control signal; a delay circuit that is coupled to the control circuit and that is adapted to receive the control signal; logic that is coupled to the delay circuit; a current generating circuit that is coupled to the logic; and a second transistor that is coupled between the current generating circuit and the control electrode of the first transistor and that is coupled the logic at its control electrode.

In accordance with a preferred embodiment of the present invention, an apparatus is provided. The apparatus comprises a current source that is adapted to provide a reference current; a first FET that is coupled to the current source at its drain, wherein the first FET is diode-connected; a second FET that is coupled to the gate of the first transistor at its gate; a third FET that is coupled to the drain of the second FET at its source and that is adapted to be coupled to an light-emitting diode at its source; an amplifier having a first input, a second input, and an output, wherein the first input of the amplifier is coupled to the gate of the first FET, and wherein the second input of the amplifier is coupled to the source of the second FET, and wherein the output of the amplifier is coupled to the gate of the third FET; an control circuit that is coupled to the gates of the second and third FETs, wherein the control circuit is adapted to receive a control signal; a delay circuit that is coupled to the control circuit and that is adapted to receive the control signal; logic that is coupled to the delay circuit; and a current generating circuit that is coupled to the logic; and a second transistor that is coupled between the current generating circuit and the control electrode of the first transistor and that is coupled the logic at its control electrode.

In accordance with a preferred embodiment of the present invention, the control circuit further comprises a fourth FET that is coupled between the gate of the second FET and ground and that is adapted to receive the control signal at its gate; a fifth FET that is coupled between the gate and source of the third FET and that is adapted to receive the control signal at its gate; and a sixth FET that is coupled between the gates of the first and second FET and that is adapted to receive the control signal at its gate.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
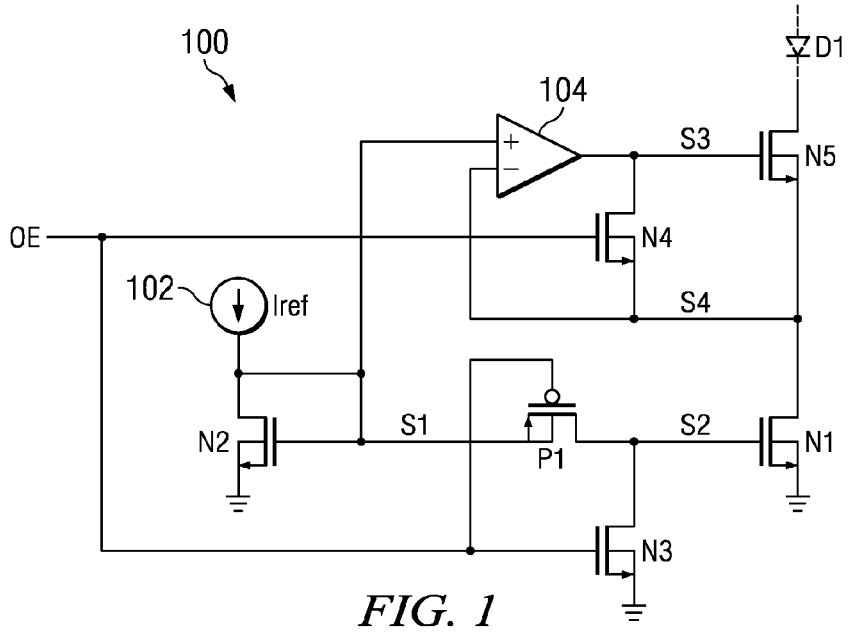
FIG. 1 is a circuit diagram of a conventional driver.
Figure 2:
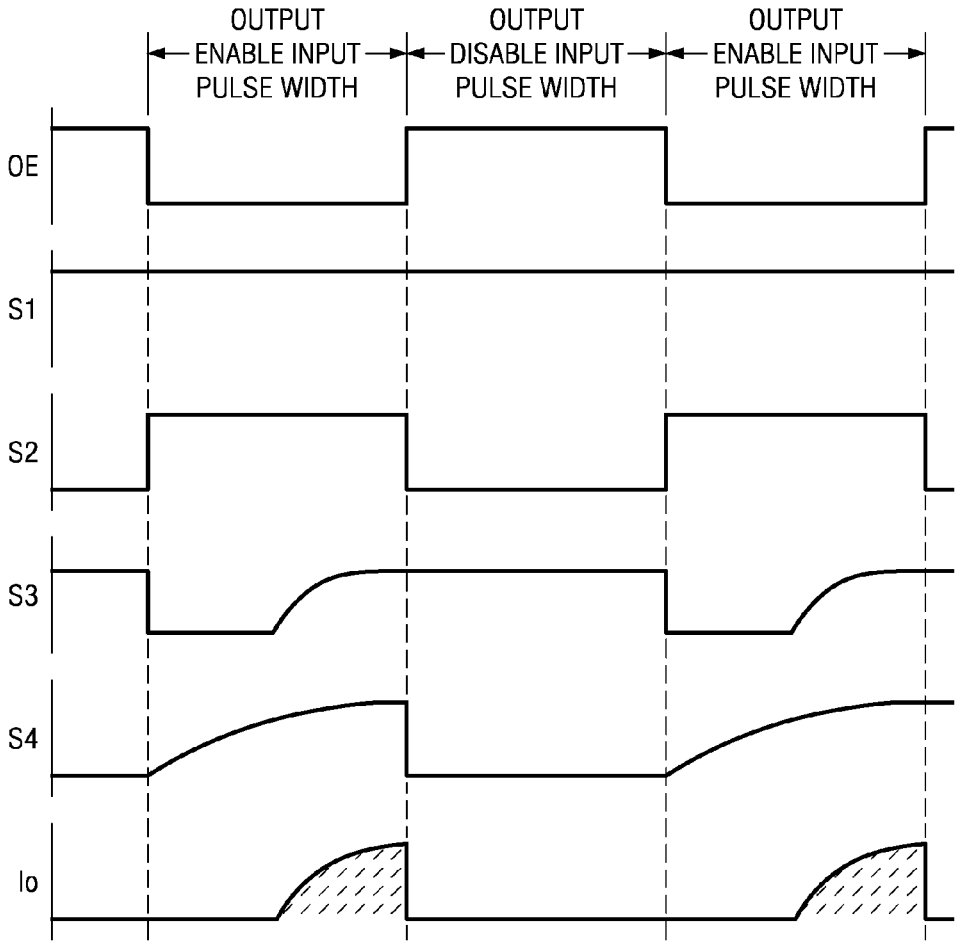
FIG. 2 is a timing diagram of the operation of the driver of FIG. 1.

Refer now to the drawings wherein depicted elements are, for the sake of clarity, not necessarily shown to scale and wherein like or similar elements are designated by the same reference numeral through the several views.

Figure 3:
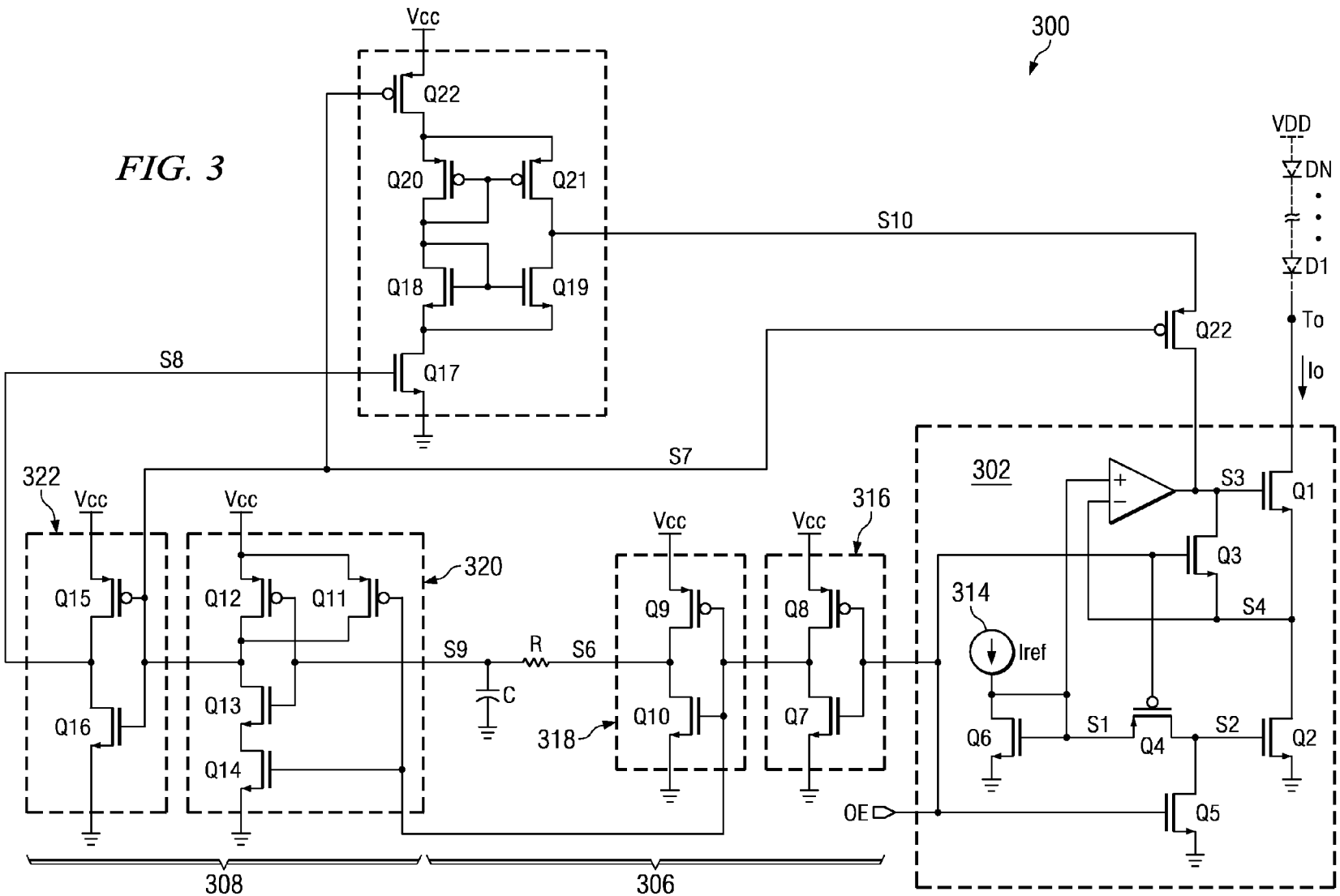
FIG. 3 is a circuit diagram for a driver in accordance with a preferred embodiment of the present invention.

Referring to FIG. 3 of the drawings, the reference numeral 300 generally designates an LED driver circuit in accordance with a preferred embodiment of the present invention. The driver 300 generally comprises an output circuit or section 302 and a presetting circuit 304. Preferably, the presetting circuit 304 comprises a delay circuit 306, logic 308, and a current generating circuit 310, while the output circuit 302 is generally comprised of transistors Q1 through Q6 and amplifier 312.

In output circuit 302, transistors Q1 and Q2 (preferably NMOS FETs) operate to generally provide the output current Io. Preferably, the source of transistor Q2 is coupled to ground (or reference potential Vss), and the drain is coupled to the source of transistor Q1 at node s4. Output terminal TO is generally formed at the drain of transistor Q1, and the cathode of the LED D1 (as the load) is coupled to output terminal TO. Here, one or more LEDs are connected in series between the drain of transistor Q1 and the power supply voltage VDD (e.g., 17 V).

Additionally, the gate of transistor Q2 is preferably coupled to the drain of transistor Q4 (preferably a PMOS FET) at node s2, and diode-connected transistor Q6 (preferably an NMOS FET) is coupled to the source of transistor Q4 at its gate. A current source 314 is preferably coupled to the drain of transistor Q6, while the source is preferably coupled to ground. Additionally, transistor Q5 is preferably coupled between node s2 and ground. In this configuration, transistor Q4 operates as an active low switch (and a portion of the control circuit that is actuated when the control signal OE is logic low), and transistor Q5 operates as an active high switch (and a portion of the control circuit that is actuated when the control signal OE is logic high). Each of transistors Q4 and Q5 allows the gates of transistors Q6 and Q2 to be coupled to one another so as to form a current mirror.

The amplifier 312 is preferably coupled to node s4 at its inverting input terminal and to node s1 at its non-inverting terminal. The output terminal of amplifier 312 is preferably coupled to the gate of transistor Q1, and transistor Q3 (preferably an NMOS FET) is coupled between nodes s3 and s4. Amplifier 312 generally provides feedback to transistor Q1, while transistor Q3 operates as a switch (and a portion of the control circuit) that is actuated by the control signal OE.

The presetting circuit 304 is also preferably coupled to the output circuit 302 to generally presets the potential or voltage of the gate of the transistor Q1 to a potential or voltage that allows current driving of transistor Q1 with a predetermined timing after a control signal OE is received. To accomplish this, delay circuit 306 receives the control signal OE. The logic 308 is preferably coupled the delay circuit 306 and is preferably coupled to the current generating circuit 310.

Preferably, the delay circuit 306 is comprised of inverters 316 and 318, resistor R and capacitor C. Inverter 316 is preferably CMOS inverter that is generally comprised of transistor Q7 (preferably an NMOS FET) and transistor Q8 (preferably PMOS FET). Inverter 318 (which is generally coupled to the inverter 316 at node s5) is preferably a CMOS inverter that is generally comprised of transistor Q10 (preferably an NMOS FET) and transistor Q9 (preferably PMOS FET). Resistor R is generally coupled to inverter 318 at node s6, and capacitor C is generally coupled between node s9 and ground. Resistor R and capacitor C form time constant circuit or RC time constant circuit, which has the function of delaying for a predetermined time the transfer of the output level of inverter 318 to the next stage.

Logic 308 is generally comprised of NAND gate 320 and inverter 322. NAND gate is preferably a CMOS NAND gate that is generally comprised of transistors Q11 and Q12 (preferably PMOS FETs) and transistors Q13 and Q14 (preferably NMOS FETs). Inverter 316 is preferably CMOS inverter that is generally comprised of transistor Q16 (preferably an NMOS FET) and transistor Q15 (preferably PMOS FET). NAND gate 320 is generally coupled to delay circuit at node s9 and generally coupled to inverter 322 at node s8.

Preferably, coupled to logic 308 is the current generating circuit 310. Circuit generating circuit is generally comprised of transistors Q20 through Q23 (preferably PMOS FETs), transistors Q17 through Q19 (preferably an NMOS transistors). Preferably, transistor Q23 is coupled between power supply Vcc and transistors Q20 and Q21 (arranged as a current mirror, while transistor Q17 is coupled between ground and transistors Q18 and Q19 (arranged as a current mirror). Additionally, the gate of transistor Q17 is preferably coupled to node s8, and the gate of transistor Q23 is coupled to node s8. Transistor Q22 is preferably coupled between nodes s10 and s3, while its gate is preferably coupled to node s7. Thus, current generating circuit 310 is able to provide a generally constant current with a clamping function.

Figure 4:
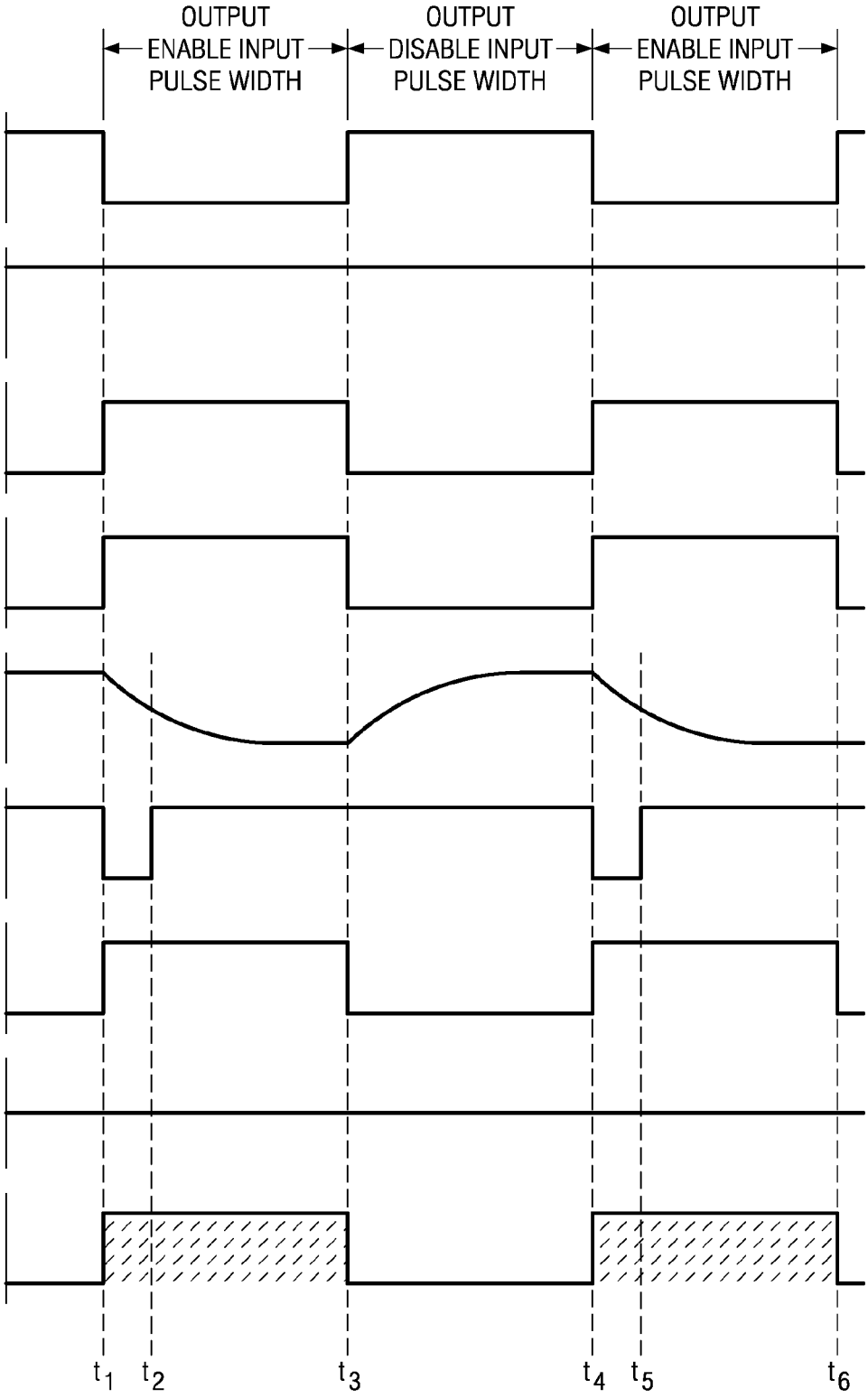
FIG. 4 is a timing diagram of the operation of the driver of FIG. 3.

Now turning to FIG. 4 of the drawings, a timing diagram for the operation of the driver 300 can be seen. At time t1, control signal OE transitions from logic high to logic low at time turning off transistors Q3 and Q5 and turning on transistor Q4. Thus, node s1 remains at logic high and nodes s2, s3, and s5 transition to logic high. The voltage at node s9 also begins to decay as capacitor C is charged. During the decay, the voltage at node s9 decreases to a point at time t2 to cause NAND gate 320 to transition node s7 (which is the pre-control signal for transistor Q22) from logic high to logic low. This allows the voltage at node s4 and the output current Io to remain generally constant by using transistor Q22 and current mirrors Q18, Q19, Q20, and Q21 to provide a supplementary charge to the gate of transistor Q1. Thus, it is clear that amplifier 312 is able to charge the gate of transistor Q1 to the desired gate potential or voltage quickly, so that it is possible to reduce the delay time and to make it possible for the transient response characteristics to be reached quickly.

As can be seen, resistor R and capacitor C determined the time constant (RC) for the delay 306. This delay time is set so that it is generally equal to the time required for amplifier 312 to charge the gate of transistor Q22. For example, it is set corresponding to the transient response characteristics of the amplifier 312.

Figure 5:
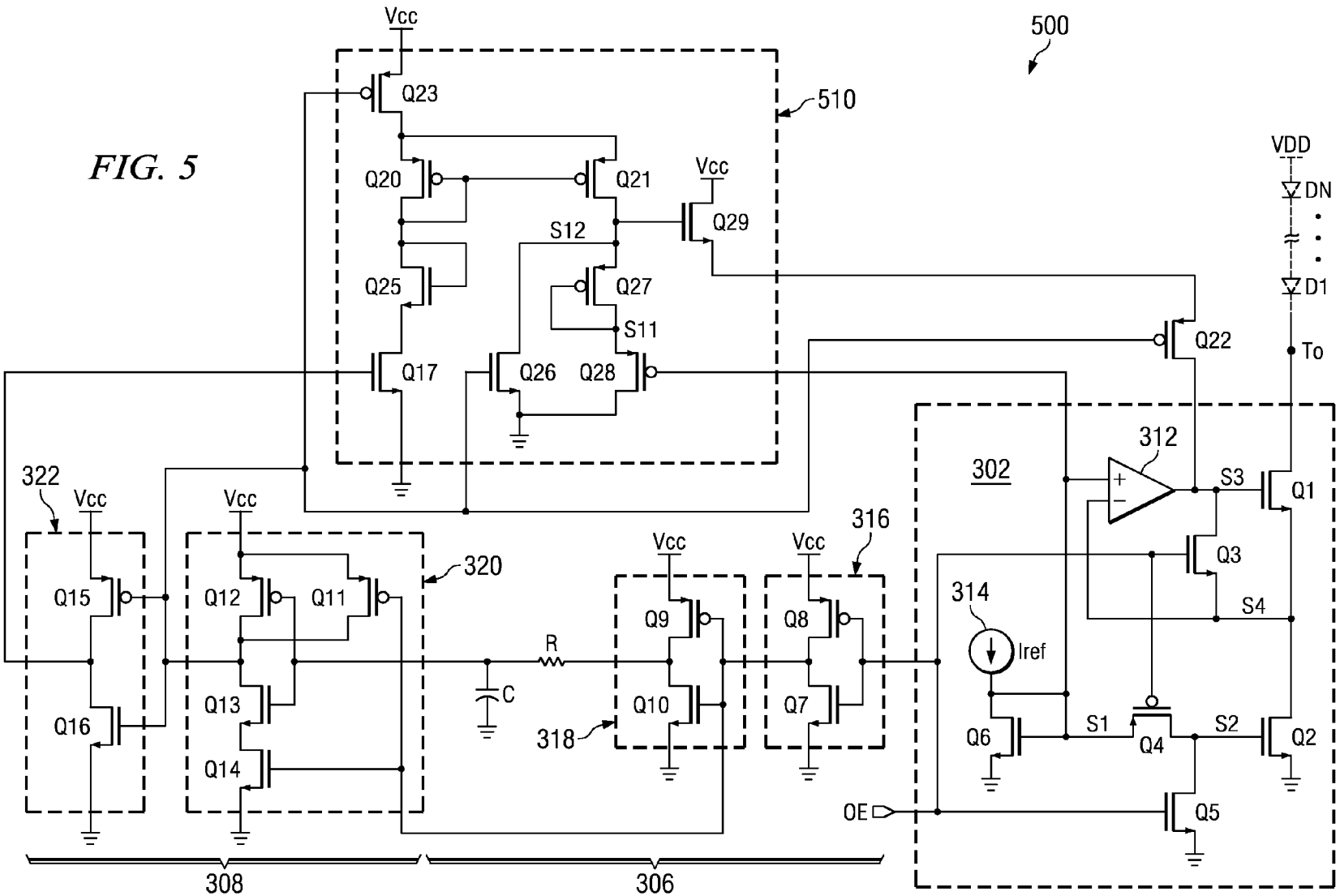
FIG. 5 is a circuit diagram for a driver in accordance with a preferred embodiment of the present invention.

Now turning to FIG. 5, another example configuration of the LED driver 500 can be seen. Generally, driver 500 has a similar structure to that of driver 300, namely in the output circuit 302, the delay circuit 306, logic 308, and transistor Q22. A difference between driver 300 and driver 500 is generally in the configuration of the current generating circuit. A reason for this difference is that, when the gate of transistor Q1 is charged via transistor Q22, there may exist a variation in the gate potential due to the supplementary charging. Also, because the charge current is high, the current from the current mirror itself should be increased, so that it is necessary to increase the current not needed for charging although it is transient.

Circuit 510 generally comprises transistors Q17, Q23, Q20, Q21, and Q25 through Q29. Transistor Q23 is preferably coupled to current mirror (transistors Q20 and Q21). Transistor Q20 is preferably coupled to diode-connect transistor Q25 (preferably an NMOS FET), which is preferably coupled to transistor Q17. Transistor Q21 is preferably coupled to transistors Q29 (preferably a NMOS FET), diode-connected transistor Q27 (preferably a PMOS FET), and transistor Q26 (preferably an NMOS FET). Additionally, transistor Q28 (preferably a PMOS FET) is preferably coupled to transistor Q27.

To increase the driving ability of circuit 510 (as compared to circuit 310), the drain of transistor Q29 is coupled to supply Vcc. The gate of transistor Q28 is connected to the non-inverting input terminal of amplifier 312. The potential of the non-inverting input terminal is at the same potential that of node s4. The potential of the source of transistor Q27 is represented as the voltage at node s4 ($V_{s4}$) plus the threshold voltage of transistor Q28 ($V_{TH1}$) plus the threshold voltage of transistor Q27 ($V_{TH2}$). This potential at node s12 becomes the gate potential of transistor Q29. The current driven by transistor Q29 flows through transistor Q22 to charge the gate of transistor Q1. In this case, the gate potential of charged transistor Q1 is the potential obtained by subtracting threshold voltage of transistor Q29 ($V_{TH3}$) from the gate potential of transistor Q29. Consequently, gate potential at node s3 can be determined by the following equation:

$$V_{s3}=V_{s4}+V_{TH1}+V_{TH2}-V_{TH3} \quad (1)$$

Here, if the threshold voltages are equal ($V_{TH1}=V_{TH2}=V_{TH3}=V_T$, equation 2 can be reduced as follows:

$$V_{s3}=V_{s4}+V_T \quad (2)$$

This is the potential obtained by adding the threshold voltage of transistor Q1 to source voltage Vs4 of output transistor Q1, and it is the originally desired gate potential. Thus, the circuit is such that the gate potential that is supplementarily charged is independent of variations in the power supply voltage.

Also, when there is a demand to increase the charging current, by increasing the size of transistor Q29 driven as a source-follower, it is possible to improve the current driving ability without increasing the bias current of circuit 510.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Accordingly, it is appropriate that the appended claims be construed broadly and in a manner consistent with the scope of the invention.

The invention claimed is:

1. An apparatus comprising:

a current source that is adapted to provide a reference current;

a current mirror that is coupled to the current source;

a first transistor that is coupled to the current mirror;

an amplifier having a first input, a second input, and an output, wherein the first input of the amplifier is coupled to the current mirror, and wherein the second input of the amplifier is coupled to a node between the first transistor and the current mirror, and wherein the output of the amplifier is coupled to the control electrode of the first transistor; and a presetting circuit that is coupled to the control electrode of the first transistor, wherein the presetting circuit presets the potential of the control electrode of the first transistor to a level that allows current driving of the transistor with a predetermined timing after a control signal is received, wherein the presetting circuit includes:

a delay circuit that is adapted to receive the control signal;

logic that is coupled to the delay circuit;

a current generating circuit that is coupled to the logic; and a second transistor that is coupled between the current generating circuit and the control electrode of the first transistor and that is coupled the logic at its control electrode.

2. The apparatus of claim 1, wherein the current generating circuit further comprises:

a third transistor that is coupled to the logic at its control electrode;

a second current mirror that is coupled to the third transistor;

a third current mirror that is coupled to the second current mirror; and a fourth transistor that is coupled to the third current mirror.

3. The apparatus of claim 1, wherein the current generating circuit further comprises:

a third transistor that is coupled to the logic at its control electrode;

a second current mirror that is coupled to the third transistor;

a fourth transistor that is coupled to the second current mirror, wherein the fourth transistor is diode-connected;

a fifth transistor that is coupled to the fourth transistor;

a sixth transistor that is coupled to the second current mirror;

a seventh transistor that is coupled to the second current mirror and the sixth transistor, wherein the seventh transistor is diode connected;

a eighth transistor that is coupled to the second current mirror, the sixth transistor, and the seventh transistor; and a ninth transistor that is coupled to the eighth transistor and the first terminal of the amplifier.

4. The apparatus of claim 1, wherein the logic further comprises:

a NAND gate that is coupled to the delay circuit; and an inverter that is coupled to the NAND gate.

5. The apparatus of claim 1, wherein the delay further comprises:

a first inverter that is adapted to receive the control signal; and a second inverter that is coupled to the first inverter.

6. The apparatus of claim 1, wherein the apparatus further comprises a control circuit that is coupled to the current minor and the first transistor, wherein the control circuit is adapted to receive the control signal.

7. The apparatus of claim 6, wherein the control circuit further comprise:

a third transistor that is coupled between the current mirror and ground and that is adapted to receive the control signal at its control electrode; and a fourth transistor that is coupled between the output of the amplifier and the current mirror.

8. An apparatus comprising:

a current source that is adapted to provide a reference current;

a current mirror that is coupled to the current source;

a first transistor that is coupled to the current mirror;

an amplifier having a first input, a second input, and an output, wherein the first input of the amplifier is coupled to the current mirror, and wherein the second input of the amplifier is coupled to a node between the first transistor and the current mirror, and wherein the output of the amplifier is coupled to the control electrode of the first transistor;

an control circuit that is coupled to the current mirror and to the control electrode of the first transistor, wherein the control circuit is adapted to receive a control signal;

a delay circuit that is coupled to the control circuit and that is adapted to receive the control signal;

logic that is coupled to the delay circuit;

a current generating circuit that is coupled to the logic; and a second transistor that is coupled between the current generating circuit and the control electrode of the first transistor and that is coupled the logic at its control electrode.

9. The apparatus of claim 8, wherein the current generating circuit further comprises:

a third transistor that is coupled to the logic at its control electrode;

a second current mirror that is coupled to the third transistor;

a third current mirror that is coupled to the second current mirror; and a fourth transistor that is coupled to the third current mirror.

10. The apparatus of claim 8, wherein the logic further comprises:

a NAND gate that is coupled to the delay circuit; and an inverter that is coupled to the NAND gate.

11. The apparatus of claim 8, wherein the delay further comprises:

a first inverter that is adapted to receive the control signal; and a second inverter that is coupled to the first inverter.

12. The apparatus of claim 8, wherein the control circuit further comprises:

a third transistor that is coupled between the current mirror and ground and that is adapted to receive the control signal at its control electrode; and a fourth transistor that is coupled between the control electrode of the first transistor and the node between the first transistor and the current mirror.

13. An apparatus comprising:

a current source that is adapted to provide a reference current;

a first FET that is coupled to the current source at its drain, wherein the first FET is diode-connected;

a second FET that is coupled to the gate of the first transistor at its gate;

a third FET that is coupled to the drain of the second FET at its source and that is adapted to be coupled to an light-emitting diode at its source;

an amplifier having a first input, a second input, and an output, wherein the first input of the amplifier is coupled to the gate of the first FET, and wherein the second input of the amplifier is coupled to the source of the second FET, and wherein the output of the amplifier is coupled to the gate of the third FET;

an control circuit that is coupled to the gates of the second and third FETs, wherein the control circuit is adapted to receive a control signal;

a delay circuit that is coupled to the control circuit and that is adapted to receive the control signal;

logic that is coupled to the delay circuit; and a current generating circuit that is coupled to the logic; and a second transistor that is coupled between the current generating circuit and the control electrode of the first transistor and that is coupled the logic at its control electrode.

14. The apparatus of claim 13, wherein the current generating circuit further comprises:

a fourth FET that is coupled to the logic at its gate;

a first current mirror that is coupled to the drain of the fourth FET;

a second current mirror that is coupled to the second current mirror; and a fifth FET that is coupled to the second current mirror at its drain.

15. The apparatus of claim 13, wherein the logic further comprises:

a NAND gate that is coupled to the delay circuit; and an inverter that is coupled to the NAND gate.

16. The apparatus of claim 13, wherein the delay further comprises:

a first inverter that is adapted to receive the control signal; and a second inverter that is coupled to the first inverter.

17. The apparatus of claim 13, wherein the control circuit further comprises:

a fourth FET that is coupled between the gate of the second FET and ground and that is adapted to receive the control signal at its gate;

a fifth FET that is coupled between the gate and source of the third FET and that is adapted to receive the control signal at its gate; and a sixth FET that is coupled between the gates of the first and second FET and that is adapted to receive the control signal at its gate.

* * * * *